US005957452A

United States Patent [19]

Patton

[11] Patent Number: 5,957,452

[45] Date of Patent: Sep. 28, 1999

[54] DICE-LIKE APPARATUS AND METHOD FOR CONSULATING THE I CHING

[76] Inventor: David L. Patton, 11105-A Mt Rose Hwy., Reno, Nev. 89511

[21] Appl. No.: 08/990,242

[22] Filed: Dec. 15, 1997

[51] Int. Cl.[6] ..... A63F 9/04

[52] U.S. Cl. ..... 273/146; 273/161

[58] Field of Search ..... 273/146, 161

[56] References Cited

U.S. PATENT DOCUMENTS

| | | | |
|---|---|---|---|
| D. 314,018 | 1/1991 | Rosenthal | D21/41 |
| 3,598,414 | 8/1971 | Dhiegh | 273/161 |
| 3,603,593 | 9/1971 | Chew | 273/161 |
| 3,834,710 | 9/1974 | Sousan | 273/138 |
| 4,239,226 | 12/1980 | Palmer | 273/146 |
| 4,309,038 | 1/1982 | Spoon | 273/428 |
| 4,465,279 | 8/1984 | Larson | 273/146 |
| 4,506,893 | 3/1985 | Perry | 273/258 |
| 4,953,864 | 9/1990 | Katz | 273/161 |
| 4,962,930 | 10/1990 | Griffith | 273/146 |
| 5,083,793 | 1/1992 | Sanford | 273/249 |
| 5,150,900 | 9/1992 | Onzo | 273/146 |
| 5,203,564 | 4/1993 | Brozas | 273/161 |
| 5,261,666 | 11/1993 | Chen | 273/146 |
| 5,425,537 | 6/1995 | Vogelsang | 273/146 |
| 5,651,682 | 7/1997 | Blok et al. | 434/403 |
| 5,890,716 | 4/1999 | Bofinger et al. | 273/146 |

FOREIGN PATENT DOCUMENTS

| | | | |
|---|---|---|---|
| 004126272 | 2/1993 | Germany | A63F 7/04 |

OTHER PUBLICATIONS

Karcher, Stephen, The Elements of the I Ching, Shaftesbury, Dorset, Rockport, Massachusetts, pp. 11–12.

Chop Wood, No Date Visible Fields et. al Carry Water p. Xii,15.

The I Ching NoDate Visible. Wilhelm, Trans. p. 280–281; 721–724.

The I Ching No Date Visible Wu Wei pp. 38–43.

I Ching No Date Visible Ritsema & Karcher pp. 18–23.

Elements of The I Ching No Date Visible Karcher pp. 11–12.

I Ching Handbook 1993 Hacker pp. 132–150.

Oracles and Divination 1981 Loewe pp. 1–2; 38–62.

*Primary Examiner*—Jessica J. Harrison
*Assistant Examiner*—David A. Fleming
*Attorney, Agent, or Firm*—Ian F. Burns

[57] ABSTRACT

The invention uses dice-like polyhedral solids (30) (32) (44) to generate randomly the lines of I Ching hexagrams. It produces outcomes according to a traditional and theoretically important frequency distribution. That distribution requires that the four line types of the I Ching system (36) (42) (38) (40) occur in a relative frequency of 1:3:5:7. The invention accomplishes this through a specific arrangement of indicia (26) (28) (46) (48) (50) on the dice. The dice are so constructed and the indicia so disposed that any roll shall yield one of the numerical results 6, 7, 8, or 9. These values correlate with the four line types, and the statistical likelihood of each possible result conforms to the theoretically ideal frequency distribution of all such results. Three dice are used in the preferred embodiment, each of a rounded, substantially tetrahedral form.

19 Claims, 6 Drawing Sheets

Figure 1A:
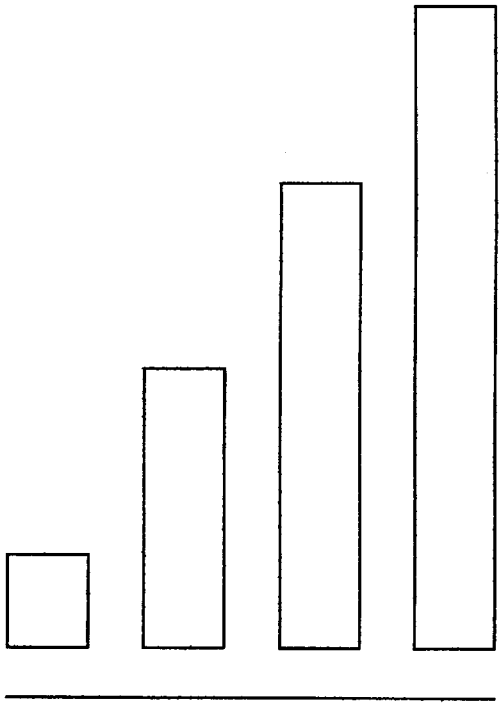

PRIOR ART
YARROW-STALK METHOD
PROBABILITIES

PRIOR ART
THREE-COIN METHOD
PROBABILITIES

PRIOR ART
GRIFFITH DEVICE
PROBABILITIES

PRIOR ART
BLOK DEVICE
PROBABILITIES

DICE-LIKE APPARATUS AND METHOD FOR CONSULATING THE I CHING

BACKGROUND—FIELD OF THE INVENTION

This invention relates to constructing hexagrams for the I Ching, and specifically to generating the different line types in the theoretically ideal ratio.

BACKGROUND—I CHING

General: The I Ching (pron. yee jing), or Book of Change, is an ancient system, between three and four thousand years old, for understanding one's place in the universe. As one of the classics of Chinese philosophy, it is a common ancestor to traditions as diverse as Taoism, Confucianism, feng shui, the martial arts, and what has been called "the new spirituality" of the late twentieth century West. (Rick Fields, et. al. 1984. *Chop wood carry water.* Los Angeles: Jeremy Tarcher. pp. xii,15.)

The I, as it is referred to by its students, has been appreciated by scholars, linguists, artists and scientists in the West for more than a century. Both the psychologist Carl Jung and the novelist Hermann Hesse were fascinated by it. Jung saw in the I a precursor to his ideas of psychological symbolism, archetypes, and synchronicity, and Hesse modeled his novel *Magister Ludi* on the system. Today a new wave of interest by philosophers, mathematicians, and scientists centers on the book's potential contributions to the study of chaos and complexity. Both the I and these new sciences are concerned with change and "sensitivity to initial conditions." One common aim of chaos and complexity studies, and of the I Ching, is to discover the order underlying seemingly random phenomena.

The I can be approached at many levels. Key among these are: as a philosophical text; as an historical record of aspects of life in ancient China; as a work of art, and as an oracle, or divinatory authority. The present invention relates specifically to this last aspect. One scholar defines "divination" as "an attempt to ascertain truth on a level other than that of verifiable analysis or quantifiable proof, and by means other than those which depend on reason." (Michael Loewe. "China," in: Michael Loewe and Carmen Blacker, eds. 1981. *Oracles and divination.* Boulder, Colo.: Shambhala. p.39) For a more thorough introduction to the I Ching, it is recommended to consult one of the many excellent references available. These include: 1) James Legge. (1874) 1964. *I Ching: Book of Changes.* Secaucus, N.J.: Citadel Press. 2) Richard Wilhelm. (1951) 1989. *I Ching, or Book of Changes*. Trans. Cary Baynes. Harmondsworth, Middlesex: Penguin. 3) Rudolf Ritsema and Stephen Karcher, translators. 1994. *I Ching: the classic Chinese oracle of change*. Rockport, Mass.: Element. 4) Wu Wei. 1995. *The I Ching: the Book of Changes and how to use it*. Los Angeles: Power Press.

To approach the I for advice is to "consult the oracle," that is, to seek help from the authority thought to speak through the book. In a spirit of meditative respect, one typically asks the oracle a question, and then generates by a random method a six-line "hexagram" which serves as the point of entry into the text of the book where advice is found. Each hexagram is also defined by its two constituent three-line "trigrams."

The present invention provides a new method of selecting the lines and hexagrams that is faithful to the spirit and intent of the ancient original method.

Lines and Hexagrams

The I Ching is a treatise on change. The system is based on deep observation of natural processes, and its key insights grow out of a philosophical stance in which change has several aspects. Recurring change, like that of the seasons following one another, is distinguished from change in which there is no subsequent return to an initial state. (Wilhelm, supra, p.280) A spring shower is thus differentiated from a catastrophic earthquake. The system codifies in lines and hexagrams the qualities of situations and the tendency for them to change in certain directions.

There are two basic line types, which represent different, opposing characteristics. They are alternatively called yin and yang, broken and solid, supple and firm, weak and strong, dark and light, feminine and masculine. Each hexagram consists of six horizontal lines of one or the other type, and is built up one line at a time, from the bottom up. There are sixty-four different hexagrams, each of which has a name, is associated with a set of qualities, and offers an interpretation of the querist's situation.

The I Ching, however, is not merely a collection of symbols; it is a guide to dynamic processes. It provides insight by linking lines, trigrams, hexagrams, and text in a systematic way. Each of the two basic line types, yin and yang, occurs in two forms, the "young," or "static," and the "old," "mature," or "changing" versions. This makes for four different line types in total. If a querist obtains one or more changing lines in the initial hexagram, she or he is directed to construct a second hexagram. Changing lines are transformed into their young, static opposites; old yin becomes young yang and old yang becomes young yin. In this way, the level of interpretation increases when the situation calls for it. The initial hexagram gives a picture of the present, and a resulting hexagram indicates how a situation might develop.

Randomness and frequency distribution

To approach the I as an oracle, one does not read it sequentially, like a novel, but approaches it through a randomly chosen symbolic key. In this way, it is thought that one allows the spirit of the book to speak directly through the medium of chance. Jung believed that this act of trusting in chance opened the mind to consider information it might not otherwise accept.

A specific set of probabilities underlies the randomness of the I Ching. Each of the sixty-four hexagrams is equally likely to occur in a given session, but the different line types are not. The lines occur with an unequal, but specific and predetermined relative frequency distribution. To fully appreciate the intricacy of the system of thought on which the I Ching is based, it is important to keep this principle in mind. Any method purporting to generate hexagrams in a way consistent with the wisdom of the I Ching must generate lines randomly according to a specific set of relative frequencies.

The originators of the I Ching determined that the phenomena they studied reflected an asymmetry in the universe. There is some intuitive obviousness to this idea. That which is weak, low, receptive, and earthly is most common, and it is relatively much less common for such a weak, low, earthly thing to become active, creative, light, heavenly. Therefore, the "young yin" line, which stands for the weak and receptive, occurs most frequently, while the "mature yin" line, which symbolizes the weak becoming strong, or the passive becoming active, occurs least frequently of all. In intermediate positions, the "young yang" line occurs second most frequently, and the "mature yang" line, which represents the active principle becoming passive and receptive, is the second most infrequent occurrence. The originators of the system determined that the relative frequencies 1, 3, 5, and 7 adequately captured the asymmetry which they observed in nature. That is to say that for every time the mature yin line is drawn, the mature yang line should be drawn three times, the young yang line five times, and the young yin line seven times. In other words, the young yin line should occur on average seven times in every sixteen random events, the young yang line five times in sixteen, the mature yang line three times in sixteen, and the mature yin line only once in sixteen times. Another way of saying this is that to encompass the relative frequency distribution of 1+3+5+7, a "sixteen-bit" system is required. For each "event" of generating a line, only four results are possible, but they derive from a set of sixteen permutations, in the ratio 1:3:5:7.

This skewed structure generates a complex statistical dynamism, which is the system's key to alignment with the dynamism of the universe. The different relative frequencies are meant to echo the relative likelihood of different kinds of change in the real world. The system operates in the range of impressively large orders of magnitude. Since there are sixteen possible ways to generate each line of a hexagram, it follows that there are $16^6$, or 16,777,216 possible ways to generate an entire hexagram.

The asymmetry works in the following way. Hexagram 2, for example, which is called Kun, Earth, Field, the Receptive, is composed of all yin lines. It can be made up of six static yin lines, six changing yin lines, or any combination of static and changing yin lines. Each variant has a different probability of occurring. Remember that the static yin line is the most common outcome, occurring seven times in sixteen, and the changing yin line is the most unlikely single outcome, occurring only once in sixteen times. Thus, the probability of casting six static yin lines is $7^6$ divided by $16^6$, but the probability of casting six changing yin lines is $1^6$ divided by $16^6$. The former outcome is 117,649 times more likely to occur than the latter. In the view of the system's originators, this precise numerical value supports the intuitive observation, noted above, that lowly things are common, but lowly things becoming radiant are extremely rare. The text for the initial hexagram in each case would be identical, but because of the changing lines in the second example, the querist would read additional text specific to the changing lines, and text for a second, resultant hexagram. The two readings would thus be very different overall. This is one aspect of "sensitivity to initial conditions" showing the importance of the individual line types occurring in the proper ratios in order to access all the relevant textual material.

The complex statistical structure has additional implications when considering the likely direction of change. The system as a whole emphasizes change in the direction of the yin principle. Although it is equally likely for a querist to obtain yin and yang lines overall, it is three times more likely to obtain an old yang than an old yin line. It is thus more common, by a factor of three to one, that changing lines will indicate movement toward rest, receptivity, and passivity than toward activity and creativity. This "texture" of the system underlies the well-known advice of Taoism to "go with the flow," and to accept the reality of a given situation rather than struggle against it. Thus, while it is possible for any hexagram to change into any other, some changes are statistically much more likely to occur than others. For example, if the six yang lines comprising Hexagram 1, Chien, Heaven, The Creative, were all mature yang lines, it would change to Hexagram 2. Conversely, if Hexagram 2, Kun, were composed of all mature yin lines, it would change into Hexagram 1. But a strong asymmetry reflects the philosophical bias of the system. The probability of the former change is $3^6$, or 729 times more likely than the latter. In order not to obscure the subtle texture and direction of the I's advice, it is important to use a method for selecting hexagrams that shares the same statistical underpinnings as the original system.

BACKGROUND—PRIOR ART: FIGS. 1A–1D

Unpatented

The original practitioners of I Ching divination used a method of dividing and subdividing fifty dried stalks of the yarrow plant to determine lines and hexagrams. This is the original method for generating the four line types in the relative frequencies of 1:3:5:7. The yarrow stalk method continues to be used today, but it is relatively difficult to master, time-consuming, and therefore not very popular. Instead, an abbreviated method of generating hexagrams using three coins is most popular among contemporary users. It is a relatively recent innovation, having come into favor in the Southern Sung period (1127–1279 A.D.). (Ritsema and Karcher, p.21) In this method, three coins are tossed simultaneously, and the four different line types are generated in the relative frequencies 1:1;3:3. Since a coin can only come up heads or tails, with three coins there are only $2^3$, or 8 possible outcomes at each toss. Since there are only eight possible outcomes at each coin toss, it follows that there are only $8^6$, or 262,144 possible permutations for generating entire hexagrams with coins. This compares with the more than 16 million permutations available with the yarrow stalk method. The coins are simple to learn and quick to use, but they generate a frequency distribution very different from that of the yarrow-stalk method, and do not do justice to the sophisticated internal consistency of the I Ching. They hinder access to its more subtle dimensions. There is a further, long-standing source of confusion in using the three-coin method. Authors differ as to which face of coins should equal "two" and which should equal "three." Consequently, users are frequently unsure as to which line type they have actually drawn.

Figure 1B:
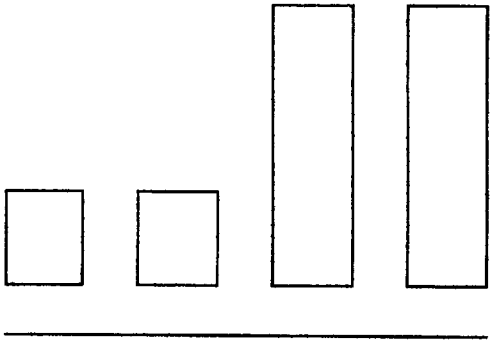

FIGS. 1A and 1B compare the frequency distribution for the four line types with the yarrow-stalk and three-coin methods, respectively. For a discussion of other methods available for constructing hexagrams, including methods using four coins, the reader is directed to: Edward Hacker. 1993. *The I Ching Handbook* Brookline, Mass.: Paradigm. Chapter 10, pp.132–150.

Two further examples of unpatented prior art must be discussed. The first is an invention in the public domain known as the "marble method," discussed by: Stephen Karcher. 1995. *Elements of the I Ching.* Rockport, Mass.: Element. pp. 11–12. At its simplest, the method requires sixteen marbles of four different colors, in the ratio 1:3:5:7. The differently colored marbles represent the four different types of hexagram lines. A user chooses any one marble, at random, records its line type, and returns it to the container holding all the marbles. The marbles are again mixed, a second marble is selected at random, the line type recorded, and the process is repeated until all six lines of a hexagram have been generated. This method succeeds in generating the yarrow-stalk probabilities, but requires a significant amount of paraphernalia, including some sort of key to remind the user which color marble stands for which line type. It is a draw-type, or lottery-type means of generating lines and hexagrams.

There are also a number of computer-based means of consulting the I Ching. Insofar as these methods generate lines according to the theoretically correct frequency distribution 1;3;5:7, they may be useful. But they are anachronistic, being based in twentieth-century electronic technology, and may therefore undermine the contemplative state preferred for consulting the I Ching. Computers also depend on compositions of matter different from that of the traditional method, and unknown to the system's originators. Electronic circuitry, silicon chips, and even coins, which are made of metal and not fiber, take the oracle into new material realms that have not been fully integrated into Chinese philosophy. In a system where sensitivity to initial conditions is a concern, this point should not be ignored. Computer systems also require a significant amount of hardware, an electrical supply, and a substantial financial outlay. Further, because of computers' liminal status as quasi-sentient machines, it may be that their use in connection with the I Ching interposes a foreign, active agent between the querist and the oracular text. Moreover, it is also generally believed that computer-based random number generation is not truly random, but I shouldn't like to be bound by this observation.

Patented

Besides the techniques above, which have been in the public domain for some time, and in some cases for many centuries, several inventions relating to the I Ching have received patents in recent times. These inventions can conveniently be divided into two main groups: 1) those providing innovative ways of casting and/or displaying the lines of hexagrams, and 2) those using the symbolism of the I Ching to impart a mystical, exotic flavor to games or fortune-telling devices of one sort or another. Within the first group there are two devices which use dice or dice-like objects. The prior art of group 1) is more directly relevant to the present dice-like apparatus. The inventions of group 2) are discussed because they also form part of the background against which the present invention must be evaluated.

1) Inventions for Casting and/or Displaying I Ching Hexagrams

Several patented devices generate and/or display I Ching lines and hexagrams. One example is U.S. Pat. No. 4,953,864, to D. Katz, for a "Method and apparatus for chance controlled formation of a symbol." Katz' invention can both generate and display lines and hexagrams. It utilizes magnets, and Katz refers to the device as the "Magnetic Oracle." In so describing the invention, Katz re-interprets the philosophy of the I Ching in a unique, and arguably spurious, way. The I Ching is about much more than attraction and repulsion, which Katz here places at the center of the system. Notwithstanding that move, Katz' device relies on a frequency distribution of probabilities completely foreign to the original I Ching. In the main embodiment, Katz' magnets generate solid and broken lines in something like equal proportions. There is no provision for generating or displaying changing lines. As I have suggested above, the concept of changing lines is absolutely essential to a proper understanding of the I.

In a later, refined embodiment of his invention, Katz states that his "arrangement . . . accomplishes . . . the 3 in 16 probability which the Yarrow Oracle method has for generating moving solid lines. Unlike the Yarrow Oracle however, the present invention gives that same probability to broken lines as well." [sic. This should read " . . . changing broken lines as well."] This statement means that, at its best, Katz' apparatus reproduces the symmetrical probabilities of the coin method, and fails to capture the intricacies of the skewed yarrow-stalk probabilities. I have suggested above that any such method is not adequate for accessing the deeper levels of the I Ching.

U.S. Pat. No. 3,598,414 was granted to K. A. Dhiegh for a "Method and apparatus for determining and studying philosophical and oracle responses." Dhiegh's apparatus is an ingenious device, which displays hexagrams generated by some other device or method. The apparatus apparently correctly displays an initial hexagram, and a resultant hexagram if there are changing lines initially. As such a display device, Dhiegh's invention seems to function admirably, and could be used instead of more traditional methods of recordation, such as pencil and paper. But insofar as his invention relies on the coin method to generate the lines of the initial hexagram, Dhiegh has also failed to appreciate the importance of the sophisticated statistical mathematics underlying the textual portions of the I Ching.

1a) Dice-like Inventions

Figure 1C:
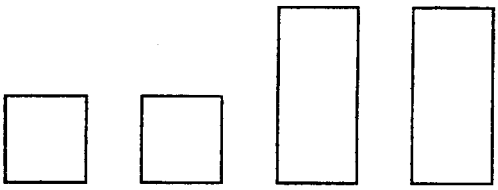

These two devices are closest in construction and use to the present invention. The first is U.S. Pat. No. 4,962,930, to A. Griffith, for his "Method and apparatus for casting an I Ching Hexagram." Griffith's invention is elegantly simple, but misses the point repeatedly stressed above. The yarrow-stalk probabilities, which form the logical, statistical foundation of the entire system of the I, describe a distribution of four different kinds of events (changing broken line, changing solid line, static solid line, and static broken line) in the relative frequencies 1:3:5:7. It takes at least sixteen "bits" of information to describe this numerical relationship adequately. The yarrow-stalk method relies on sixteen permutations to generate an asymmetric distribution of four outcomes, and the popular but inaccurate coin method uses eight permutations to generate a symmetrical distribution of the four outcomes. (FIGS. 1A and 1B) But Griffith's method, since it relies on a single cubic die for each line, allows only six permutations for each line. His method is even less sensitive than the coin method, and it generates a symmetrical distribution of the four line types in the relative frequency 1:1:2:2. (FIG. 1C) Griffith's dice are tossed all at once, to generate a hexagram with one throw. They provide a shortcut to a consultation with the oracle, but seriously distort the system in the interest of convenience. In contrast to the more than 16 million possible ways to generate hexagrams with the yarrow-stalk method, Griffith's dice offer only 46,056 possibilities, or $6^6$.

Figure 1D:
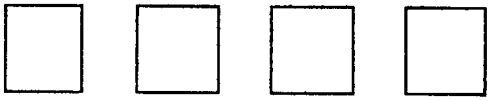

Another patented invention, U.S. Pat. No. 5,651,682, to F. J. Blok, et al., of the Netherlands, for "Sticks and method for consulting Chinese book of changes," is similar to Griffith's method and apparatus. Like Griffith's invention, Blok's sticks generate all six lines of a hexagram at one throw, and they display the lines of hexagrams directly. When one rolls a stick and obtains a broken line, that stick with broken line is used as the display. Like Griffith's invention, with its six-bit mathematical basis, Blok's sticks completely disregard the sixteen-bit yarrow-stalk method I have stressed throughout. Blok's device is only a four-bit system; it generates the four line types in equal proportions, that is, 1:1:1:1. (FIG. 1D) The reader will by now appreciate how foreign this is to a proper approach to the I Ching, and how inadequate it is for helping a user to explore the depths of the system. Blok's sticks give only 4,096, or $4^6$ ways to generate hexagrams.

2) Inventions Employing I Ching Symbolism

As a class, the inventions in the second group re-interpret the I Ching in ways quite foreign to its intended application. As examples of this, U.S. Pat. No. 4,506,893 to M. Perry, U.S. Pat. No. 5,203,564 to C. Bruzas, and U.S. Pat. No. 3,603,593 to K. Chew, are noteworthy. Perry's "Method of playing a game in which playing pieces are inverted" abstracts the numerical order of I Ching hexagrams to provide a rational, but random chance device for the layout of the 64 squares of his playing board. He relied on the underlying pattern of the I Ching without making it explicit, and without aiding game players to understand its origins.

In Bruzas' "Methodology board for selecting gaming numbers," all the I Ching hexagram numbers and their symbols are reproduced, as well as what he calls the "yin and yang symbol," which the Chinese know as tai chi. In this invention, the I Ching symbolism is background for the desired end of "picking gaming numbers and telling fortunes." The I Ching symbolism is mixed with "mystic symbols" from several traditions. The symbols are meant to give the flavor of a mystical or spiritual endeavor, but their interpretation is optional to the main point of the invention, which is to choose random numbers. Bruzas' method of choosing an I Ching hexagram, which is similar to that of an Ouija board, bears no relation to the frequency distribution of the yarrow-stalk method, and takes no account of changing lines, both of which are fundamental to an understanding of the I.

Chew's "I Ching fortune-telling game" turns the ancient oracle into a parlor game for amusement and wagering, both of which concepts are foreign and somewhat antithetical to the nature of the original text and the reverent attitude with which it is usually approached. More to the point, Chew's special eight-sided dice are not configured to generate hexagram lines according to the proper, yarrow-stalk odds. Rather, they replicate the odds obtained with the coin method.

SUMMARY OF THE DISADVANTAGES OF THE PRIOR ART

1) Ignorance of the Underlying Structure of the I Ching

The prior art nearly universally misses the point of the unequal frequency distribution of the four line types and the system's underlying statistical dynamism. The three-coin method, Griffith's dice, Blok's sticks, and Katz' magnets all introduce logical, mathematical relationships foreign to the I Ching. There is widespread ignorance of the fact that not all randomness is the same, and a failure to appreciate the ways in which the originators of the system modeled the coherence of the I Ching on the coherence they observed in the cosmos.

2) Trivialization

The type of arbitrary re-interpretation and re-contextualization of the I Ching evident in a number of methods for generating lines and hexagrams obscures the deeper levels of meaning in the system. The I Ching, which is highly formalized, internally consistent, and which has been revered for millennia, is trivialized when made into games. Related to this observation is the idea that coins may be "contaminated" by their connection to daily commerce.

3) Inconvenience

Computer programs and the marble method, even if they do reproduce the proper frequency distribution of line types, both require significant amounts of equipment. Even the smallest computers take up significant space, and require an external power source. Computer-based methods, moreover, are expensive, demand a certain level of sophistication on the part of users, and interpose an extraneous, semi-active agent, namely the computer, between the user and the I Ching. Devices such as Katz' "Magnetic oracle" are complicated and inconvenient. The yarrow-stalk method is unnecessarily arcane.

4) Anachronism

Computers, to the greatest degree, but also coins, plastic dice, and the shortcut devices of Griffith and Blok are anachronistic. They are clearly products of our age, and betray our fascination with speed and convenience, at the expense of approaching the I Ching on its own terms. At the very least, most of these methods sacrifice accuracy, precision, and depth of understanding for speed.

5) "Busy-ness"

Certain devices call undue attention to themselves and their workings. Some computer programs for the I Ching, as well as inventions such as Katz' magnetic oracle and Bruzas' game board, introduce unnecessary gimmicks and gadgets into what is most properly a respectful, meditative, contemplative consultation.

6) Too Much Novelty

In connection with a system of thought as ancient as the I Ching, too much novelty might not be a good thing. Methods for consulting the oracle that require learning entirely new techniques, or that take the oracle into new material realms, may alter initial conditions in unpredictable ways. These might put off potential users, no matter how accurate the method. Coins, computers, marbles, magnets, and plastic dice all deviate from the original plant-based yarrow-stalk method in very significant logical and material ways.

Objects and Advantages

Objects

It is the principal objective of the present invention to allow a user of the I Ching to generate lines and hexagrams according to the same frequency distribution as the yarrow-stalk method, while maintaining the ease of using coins. It is thus an objective of the present invention to provide a truly random dice-like means of generating lines and hexagrams. It is a further objective to encourage users of the I to reach a deeper appreciation and understanding of its philosophy and underlying logical structure. It is a further objective to reintroduce users of the I Ching to the original, unadorned, undiluted intricacy of the system. This has been lost over several centuries of using inadequate and inaccurate shortcuts to obtain oracular readings.

Advantages

The I Ching is a sophisticated, ancient means of gaining insight into the cosmos, and has been of interest to millions of people over thousands of years. Recently, it has attracted the attention of Western scientists, mathematicians, and scholars who find in it evidence that chaos and complexity, the subject of two new Western sciences, were understood by the ancient Chinese. A key principle in these studies is the concept of sensitivity to initial conditions. The dice address this idea especially directly. Methods which do not reproduce the yarrow-stalk probabilities alter the initial contact with the system, and lead to improperly skewed results.

My dice reproduce the traditional set of probabilities with an apparatus and method that are easy to use, aesthetically pleasing, and respectful of the I. They return a user to the system's roots, with a minimum of re-interpretation or dilution. The dice distill the essence of the tradition, add only convenience of use and transparency of method, and take away none of the gravity, dignity, and precision of the ancient means of consulting the oracle. They restore the initial conditions essential to a fuller understanding of the I Ching.

The use of the dice is intuitively obvious. It is clear how to obtain the numerical totals, and a key is provided for even greater assurance. The dice are a dedicated device for study or ritual use, unlike common coins, which may be thought to be contaminated through their connection with everyday commerce. The dice are very easily portable, in a pocket or pouch, unlike even the smallest computer. Further, in the preferred embodiment, the dice are a hand-made craft product with traditional associations, unlike computers, plastic dice, or even coins, with their more modern, industrial overtones.

The dice improve on all known methods of generating hexagrams, but they resonate with both dominant extant systems, and can be readily adopted by users of either or both. Like the coin oracle, this invention uses three objects, and employs only the numbers "2" and "3." But the dice correct for the inaccurate frequency distribution the coin method produces. Further, the preferred embodiment of the apparatus echoes the yarrow stalk procedure in a logical way. It takes the form of three dice marked in two distinct ways, that is to say, A,B,B. It is thus the logical equivalent of the yarrow-stalk method, in which there are three steps, the first being different from the subsequent two, which are identical. With the yarrow stalks, a first step produces either a 2 or a 3 in the relative ratio 1:3, and the two subsequent steps each produce either a 2 or a 3 with equal probability, that is in a 1:1 ratio. This is exactly what the preferred embodiment, or the "tri-dice" form of the present invention does. It thus provides a direct analogue of the most ancient, traditional method for consulting the oracle.

Further advantages are that the present invention can be made of organic, plant-based material, such as wood. This is consistent with the plant-based origins of the original yarrow method, the importance of which is stressed in some of the scholarly literature. In addition, in the preferred embodiment, the invention produces $4^3$, or sixty-four possible permutations, which equals the total number of hexagrams.

A further advantage of the present invention is that it improves even on the yarrow-stalk method. Two fundamental concepts of the I Ching are "the easy" and "the simple." The dice are both easier and simpler to use than yarrow-stalks.

SUMMARY OF ADVANTAGES OF THE PRESENT INVENTION

1) Recognizes Underlying Structure

The dice recognize and respect the underlying logical structure of the I Ching. They emphasize, reinforce, and aid understanding of the philosophical system.

2) Non-trivial

Although they are extremely simple, the dice are a non-trivial improvement for consulting the oracle. They foster a dignified, respectful approach to the I Ching, and solve the long-standing problem of how to embody the correct set of probabilities in an elegant, intuitively straight-forward device.

3) Convenient

The dice are convenient to use, economical, and easily portable.

4) Not Anachronistic

Since the dice are a craft-based object, they might have been made in ancient China, and thus do not rely on anachronistic modern technologies. Although the preferred embodiment employs laser-engraved numerical indicia, this feature is optional. The laser gives an elegant, precise, and refined look to the finished apparatus, and is not used to produce a "high-tech" effect.

5) Not Overly "Busy"

The dice are free of gimmicks. They comprise an elegant, simple device that does not shout its own importance.

6) Not too Much Novelty

The invention clearly echoes the two most popular methods of generating hexagrams in current use, without requiring a user to learn new methods entirely foreign to the I Ching's system. With the use of wood in the preferred embodiment, the dice mark a return of the oracle to its organic, plant-based origins.

DRAWING FIGURES

FIGS. 1A–1D. Comparison of line type frequency for four methods.

Figure 2A:
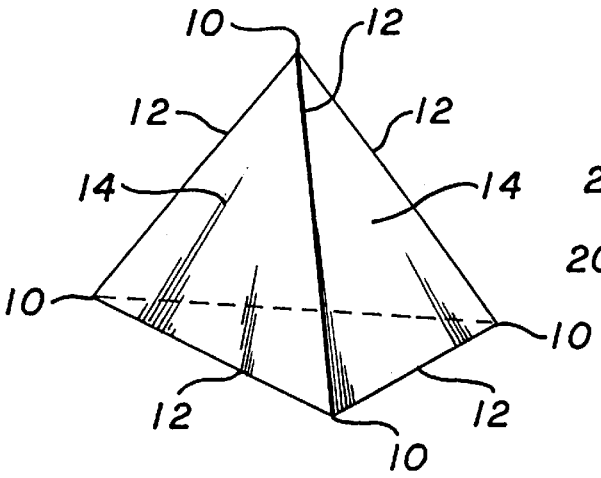
Figure 2B:
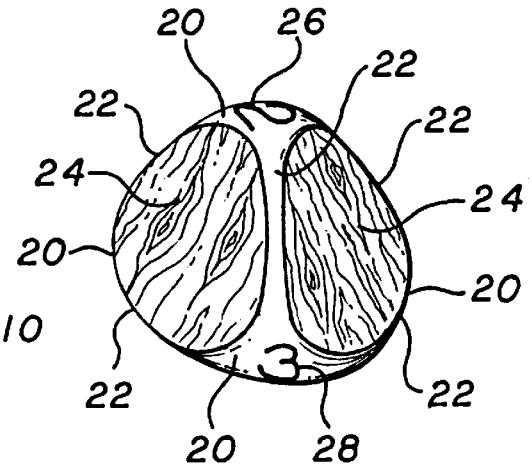

FIGS. 2A and 2B. Comparison between a regular tetrahedron and the rounded, substantially tetrahedral form of the preferred embodiment.

Figure 3:
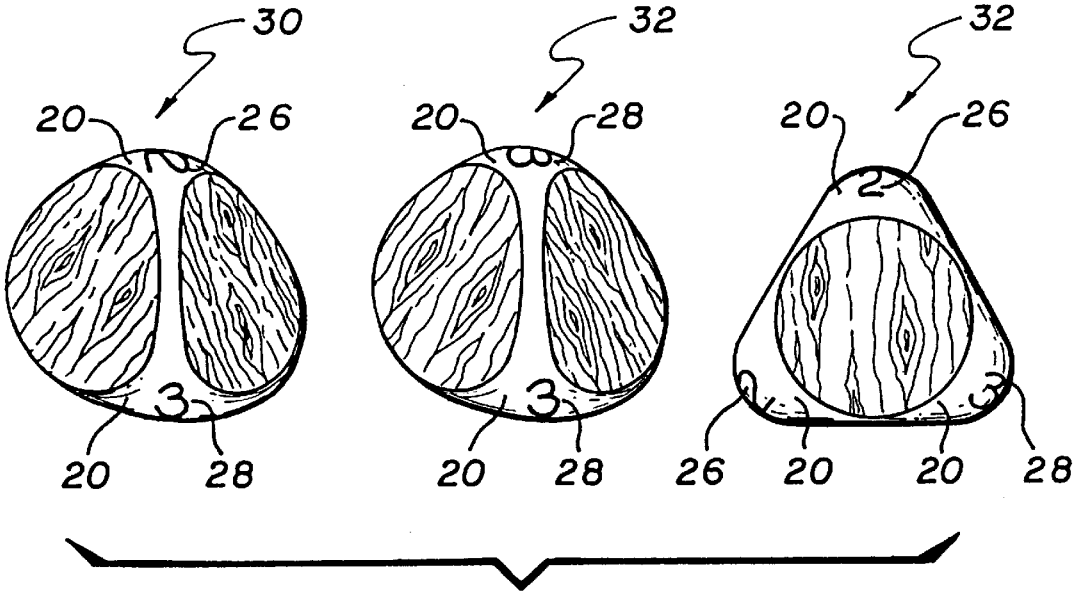

FIG. 3. The preferred embodiment of the invention.

Figure 4A:
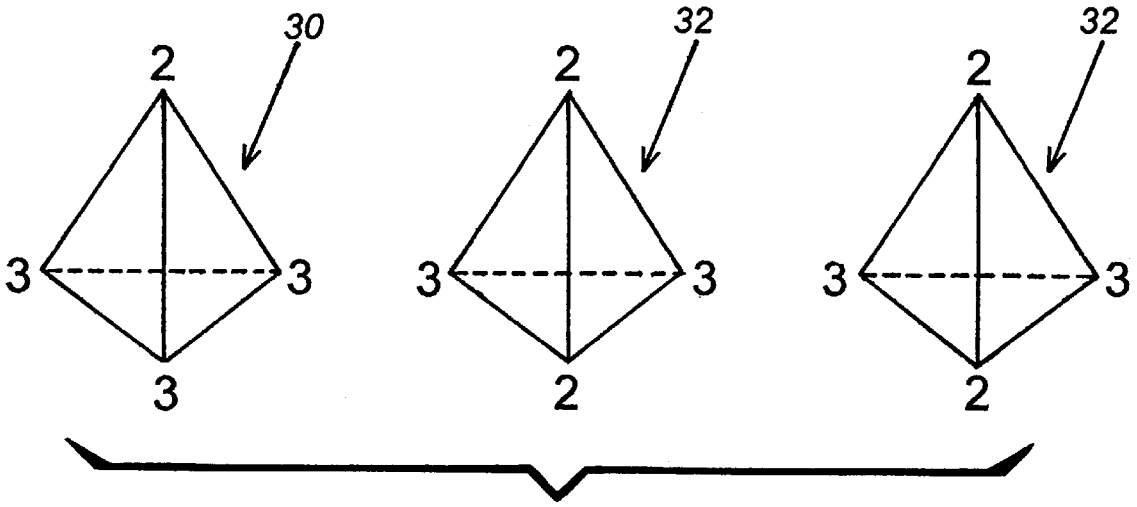
Figure 4B:
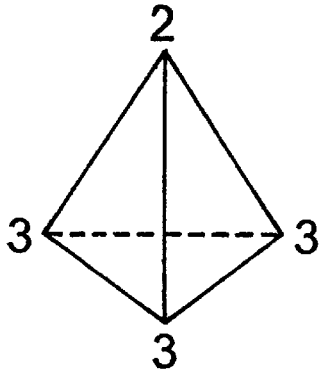
Figure 4C:
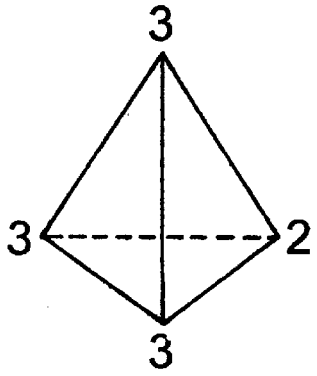
Figure 4D:
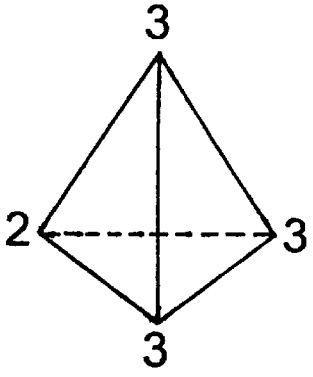
Figure 4E:
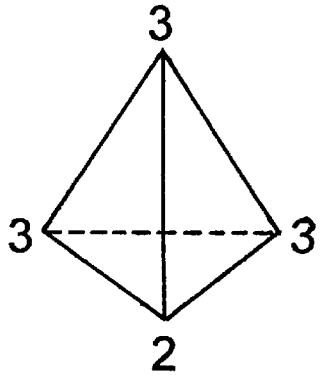

FIG. 4A. The preferred embodiment, in schematic.

FIGS. 4B–4E. The four possible orientations of the 2,3, 3,3 die.

Figure 5:
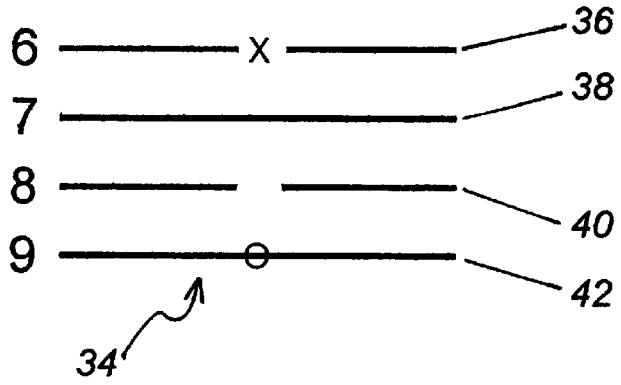

FIG. 5. Key to the four line types, with numerical values.

Figure 6A:
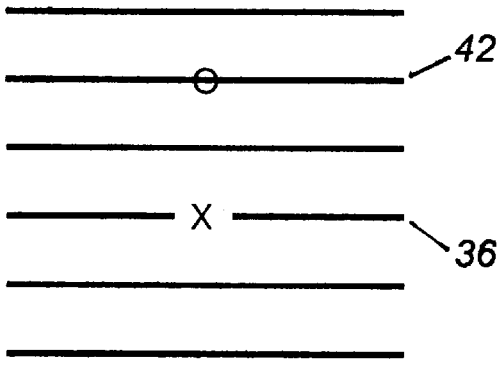
Figure 6B:
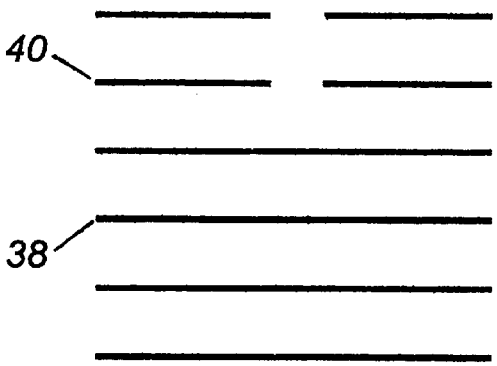

FIGS. 6A and 6B. An initial hexagram with two changing lines, and a resultant hexagram.

Figure 7:
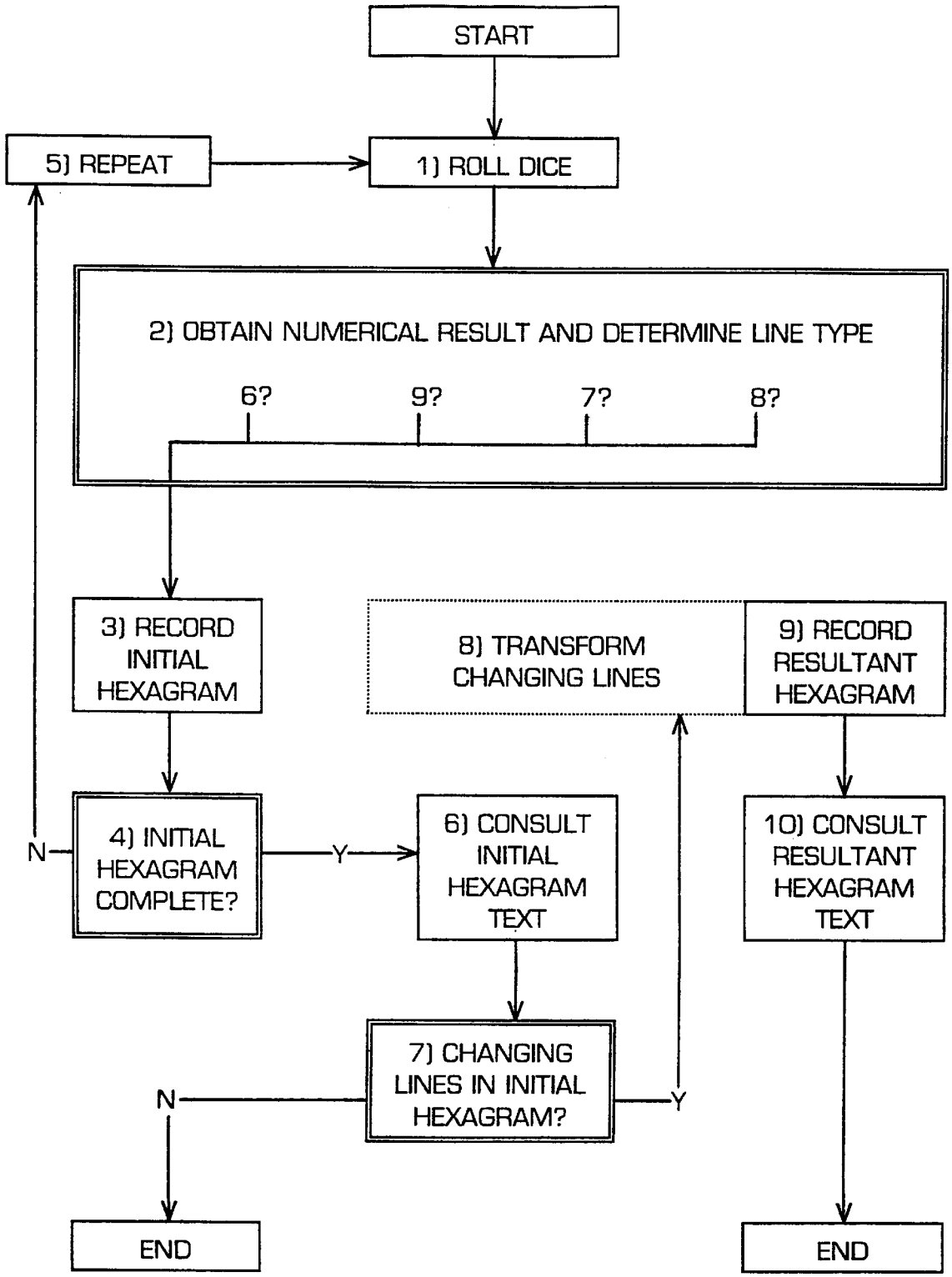

FIG. 7. Flowsheet of the method.

Figure 8A:
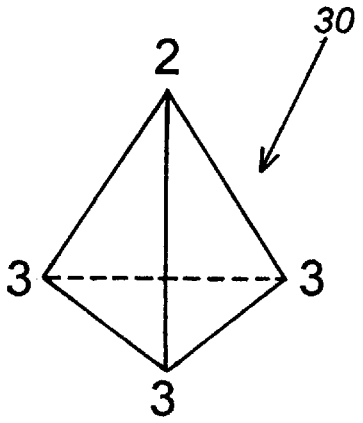
Figure 8B:
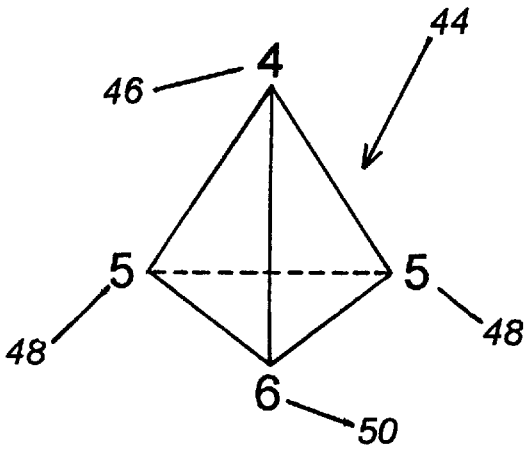

FIGS. 8A and 8B. Bi-dice embodiment, in schematic.

LIST OF REFERENCE NUMERALS

10=vertex of regular tetrahedron
12=edge of regular tetrahedron
14=face of regular tetrahedron
20=rounded vertex of die
22=rounded edge of die
24=face of die
26=numeral "2"
28=numeral "3"
30=the 2,3,3,3 die
32=the 2,2,3,3 dice of the tri-dice embodiment
34=key to line types
36=the mature yin line -x-
38=young yang line —
40=the young yin line - -
42=the mature yang line ~~o~~
44=the 4,5,5,6 die
46=numeral "4"
48=numeral "5"
50=numeral "6"

SUMMARY OF THE INVENTION

The invention is an apparatus and method for consulting the I Ching. It uses dice-like polyhedral solids to generate randomly the lines of I Ching hexagrams. The dice improve on the prior art by producing outcomes according to a traditional and theoretically important frequency distribution. That distribution requires that the four line types of the I Ching system occur in a relative frequency of 1:3:5:7. The invention accomplishes this through a specific arrangement of indicia on the dice. The dice are so constructed and the indicia so disposed that any roll shall yield one of the numerical results 6, 7, 8, or 9. These values correlate with the four line types, and the statistical likelihood of each possible result conforms to the theoretically ideal frequency distribution of all such results.

Main Embodiment—Description: FIGS. 2A–4E

In the preferred embodiment, the invention comprises three substantially identically-shaped, substantially tetrahedral solids which each have four rounded vertices bearing indicia. FIGS. 2A and 2B compare a regular tetrahedron and a rounded tetrahedral form preferred for the invention. The rounded, tetrahedral form can also be called a "die," and two or more can be called "dice."

In a regular tetrahedron, there are four equilateral triangular faces, four vertices where three faces and three edges converge, and six discrete edges. FIG. 2A illustrates the features of a regular tetrahedron. In this view all four of the tetrahedron's vertices (10), five of its six edges (12), and two of its four faces (14) are indicated. Each face of a regular tetrahedron is an equilateral triangle bounded by three sixty-degree angles, and any two adjacent faces are separated by a dihedral angle of 70.53 degrees. Each vertex is equidistant from every other vertex. A tetrahedron has four axes of symmetry. Conventional tetrahedral dice are well known in the art.

The rounded tetrahedral form of FIG. 2B retains the structural, geometrical relationships of the regular tetrahedron including the four axes of symmetry. The preferred form of the dice is thus essentially a regular tetrahedron with rounded-over, eased, or smoothed edges and vertices. This modification provides improved rolling action over that of a conventional tetrahedral die. The four rounded vertices also provide convex surfaces on which indicia are inscribed. The four substantially flat faces provide surfaces of stable equilibrium on which the dice come to rest. The rounded edges and vertices provide surfaces of unstable equilibrium on which the dice cannot come to rest. Each axis of symmetry passes through the center of one face and the vertex opposite. Thus, when the dice come to rest on one of the four faces, one of the four vertices with its indicium comes to rest facing "up" in a common reading position. FIG. 2B shows the rounded form from the same angle as the view of the regular tetrahedron in FIG. 2A in order to emphasize the geometrical correspondence between the two forms. In FIG. 2B all four rounded vertices (20), five rounded edges (22), and two of the die's four faces (24) are shown. In addition, two of the die's four indicia are shown, namely a numeral "2" (26), and a numeral "3" (28). The numeral "2" is in a common reading position, indicating a "result" or "outcome" in this example.

In the preferred embodiment, the dice are made of wood. The rounded tetrahedral shape exposes the wood grain in various orientations which highlight the natural beauty of the material. The wood of the preferred embodiment is North American hard maple. It is hard and dense, and has a close grain without open pores.

FIG. 3 shows a perspective view of three rounded tetrahedral dice, comprising the preferred, "tri-dice" embodiment of the invention. The three dice are substantially identical in form, size, weight, etc. The dice are of such a size that all three may be held in a pair of cupped hands and shaken together.

The dice are marked differently. One die (30) is marked with one numeral "2" (26) and three numerals "3" (28), one per rounded vertex (20). For simplicity this can be called a "2,3,3,3" die. The other two dice (32) are marked identically, each with two numerals "2" (26) and two numerals "3" (28), one per rounded vertex. For simplicity these can be called "2,2,3,3" dice. The indicia on all three dice are printed, burned, engraved, carved, or otherwise permanently inscribed or affixed to the rounded vertices (20). In the preferred embodiment the numerical indicia are engraved into the surface of the wood using a laser. The laser mark is permanent and very legible, leading to unequivocal results.

FIG. 4A introduces a notation to show in a single view the structural disposition of all the indicia. It draws on the underlying equivalence established in FIGS. 2A and 2B between the rounded form of the preferred embodiment and that of regular tetrahedra. FIG. 4A shows the tri-dice embodiment of FIG. 3 in schematic form. It will immediately be apparent how the 2,3,3,3 die (30) and the 2,2,3,3 dice (32) are structurally identical, but bear different indicia. This notation emphasizes that the dice are marked so that in a state of rest one indicium per die appears in a common reading position. Each die can come to rest on any one of its four faces, and the notation makes it possible clearly to display these permutations. FIGS. 4B–4E show all possible orientations of the 2,3,3,3 die (30).

It is important to exercise care in manufacture to assure that the dice are as uniform as possible. In this way they will most nearly comprise a truly random device in which each vertex has a substantially equal likelihood of coming to rest facing up. The tetrahedral form's four axes of symmetry, and the fact that all vertices are evenly spaced relative to each other are natural, structural aids to this desired end. A number of machining operations, including sawing, grinding, sanding, and lathe turning can be used effectively to shape the dice.

Main Embodiment—Operation: FIGS. 5–7

The invention embodies the frequency distribution of the traditional yarrow-stalk method in a dice-like apparatus and method. In the preferred embodiment, this means that three dice are rolled together on a flat surface such as a table. When they come to rest, the numerical values appearing in the uppermost, common reading positions are summed, as with conventional dice. A total of either six, seven, eight, or nine will be obtained. This is apparent from the schematic of FIG. 4A. The total is noted, and reference is made to a key (34), shown in FIG. 5. The key establishes an equivalent line type for each of the four possible outcomes, or results. As indicated in the key, a total of 6 represents the mature yin line (36), 7 the young yang line (38), 8 the young yin line (40), and 9 represents the mature yang line (42). The correct line type is recorded as the first line of the initial hexagram. The procedure is repeated five times until six lines have been generated and recorded. At this point the querist refers to the text of the I Ching for interpretation of the hexagram that has been obtained. An example of a hexagram is shown in FIG. 6A. This is the symbol of Hexagram 58, Tui, Joy.

If changing lines are obtained in an initial hexagram, as they are in this example, the respective lines are changed, a second hexagram is generated, and the querist refers to the text of the I Ching for interpretation of that resultant hexagram. The initial hexagram of FIG. 6A has a mature yin line (36) in the third place, and a mature yang line (42) in the fifth place. Line places are always counted from the bottom. When the mature lines of FIG. 6A are changed into their opposites, the result is the hexagram shown in FIG. 6B. In this case, the resultant symbol is Hexagram 34, Ta Chuang, Great Power. It will be noted that the mature yin line (36) from the third place of FIG. 6A has become a young yang line (38) in FIG. 6B. Likewise, the mature yang line (42) has here become a young yin line (40).

The method of operation is summarized in the flowsheet, FIG. 7. Box 1 represents the step of rolling the dice. In the preferred method of operation, the dice are shaken together in the hands and rolled across a flat surface. When the dice come to rest, a numerical result is obtained, and an evaluation is made of which line type has been generated. The querist may refer to the line type key (34) shown in FIG. 5. This step is represented by Box 2. The next step is represented by Box 3, in which the appropriate line type is recorded in the proper line position for the hexagram being generated initially. Hexagrams are always constructed from the bottom line up. These steps are repeated (Box 5) until a complete six-line hexagram is completed (Box 4).

When an initial hexagram is completed, the user consults the text of the I Ching for its interpretation, shown as Box 6. The querist determines (Box 7) whether the initial hexagram includes any mature or changing lines. If not, this is the end of the consultation. If changing lines are present in the initial hexagram, the user transforms them into their opposites, and records the resultant hexagram. These steps are represented by Box 8 and Box 9. Mature yin lines become young yang lines, and mature yang lines become young yin lines. In the transformation from the initial hexagram to the resultant hexagram, lines do not change position. That is, a mature yin line in the third line position of the initial hexagram, becomes a young yang line in the third line position in the resultant hexagram, as illustrated in FIGS. 6A and 6B. Static lines, if any, do not change; they are simply copied from their original positions in the initial hexagram to the corresponding line positions in the resultant hexagram. Once the resultant hexagram has been recorded, the user consults the text of the I Ching for an interpretation of its meaning (Box 10). This completes the consultation.

Alternative Embodiment: FIG. 8

Description

In addition to the "tri-dice" version of the preferred embodiment discussed above, it is possible to replicate the yarrow-stalk probabilities with "bi-dice" versions using only two dice. One such bi-dice version is shown in schematic form in FIGS. 8A and 8B. Physically, the dice of the bi-dice version are shaped identically to those of the preferred embodiment, that is, the rounded, substantially tetrahedral form shown in FIG. 2B and FIG. 3. It will be noted that one die of the bi-dice version is identical to one die of the tri-dice version. That is to say that the 2,3,3,3 die (30) of FIG. 8A is identical to the 2,3,3,3 die (30) of FIG. 4A. The second die of the bi-dice embodiment can for simplicity be called a 4,5,5,6 die (44). It is shown in FIG. 8B. The 4,5,5,6 die is substantially identical to the other dice so far described, except for its different indicia. Whereas the dice previously described bear only indicia "2"s, and "3"s, the 4,5,5,6 die bears one numeral "4" (46), two numerals "5" (48), and one numeral "6" (50) on its four rounded vertices.

Operation

The bi-dice embodiment is operated in the same way as the preferred embodiment. The dice are shaken together and rolled across a flat surface such as a table. When the dice come to rest, the numbers on the uppermost vertices are summed, reference is made to the line key (34) shown in FIG. 5, the correct line type is recorded, and the procedure is repeated until a six-line hexagram is generated. The querist turns to the text of the I Ching for an interpretation of the hexagram. As before, if any changing lines occur in the initial hexagram, they are changed into their opposites, and the resulting hexagram is recorded. Reference to the text of the I Ching is again made for an interpretation of that hexagram.

Conclusion, Ramifications, and Scope of Invention

Conclusion

Thus the reader will see that the dice of the invention provide an economical, portable, intuitively easy, and heretofore unknown apparatus and method for generating I Ching lines conforming to the traditional yarrow-stalk probabilities.

While my above description contains many specificities, these should not be construed as limitations on the scope of the invention, but rather as exemplifications of preferred embodiments thereof. Many other variations are possible, some of which will be discussed below.

Accordingly, the scope of the invention should be determined not by the embodiments illustrated, but by the appended claims and their legal equivalents.

Ramifications

Having discussed the preferred way to embody the yarrow-stalk probabilities in a dice-like apparatus, a great number of ramifications on the basic idea need to be mentioned. These can be grouped, for simplicity, into: 1) variations on the shape or form of the dice-like objects, 2) alternative materials, 3) different indicia, 4) variations on the number of dice-like objects, 5) different methods of operation, and 6) "hybrid" apparatus.

1) Variations on the Shape or Form of the Dice-like Apparatus

A number of geometric shapes can be used instead of the rounded tetrahedral form of the preferred embodiment. They include: any and all other tetrahedral forms, including regular tetrahedra and truncated tetrahedra; arrangements such as four closely-packed spheres; spheres or other solid forms attached to stalks, like children's jacks; spheres with flats or facets allowing the sphere-like shapes to come to rest on pre-determined surfaces; rectangular prisms more long than they are wide, like matchsticks; similar prism shapes with 8, 12, 16 or more elongated flat sides; octahedral, dodecahedral, and icosahedral forms, including regular, truncated, and other modified forms; and other special dice-like objects with 4, 8, 12, 16, 20, 24, and more faces or sides. The essential characteristic necessary to capture the asymmetrical probabilities of the yarrow-stalk method is four-sided-ness. That is to say, at least one dice-like object of however many comprise an entire apparatus must have surfaces bearing indicia equally likely to "come up" in a number divisible by four. The dice-like means of whatever geometric form must be capable of indicating four distinct outcomes in the relative frequency distribution 1:3:5:7. An exception to the requirement of four-sided-ness is made for the ramifications discussed infra under the heading "Sixteen dice."

2) Alternative Materials

The dice can be made of a number of different materials. They can be constructed of wood, as in the preferred embodiment, but might also be made of: folded paper; cast, molded, or machined plastics; metal; stone; bone; horn; ceramics; wire frames; and other materials. They may be rendered in animation or as images on a computer screen.

3) Different Indicia

A number of different indicia might be used instead of the specific numerals discussed above. The choices include alternative numerals, and symbols other than numerals which would indicate an equivalent value. For example, Chinese numerals could be used. But more generally, any numerals or abstract indicia might be used, provided that a clear equivalence is established between the indicia and the relevant line types. Two dots or three circles could be used, or colors might be used to represent numerical values, say red for two and black for three. In certain embodiments discussed below, the dice may be marked with symbols for the I Ching line types themselves, instead of with representative numerical values. For example, each face of a single sixteen-sided die, or each individual die in a set of sixteen dice, can be marked with the symbol of one of the line types, so long as the total relative frequencies are kept at 1:3:5:7.

I emphasized the numerals "2" and "3," and the line values six, seven, eight, and nine in the discussion above because of their connections with older methods of consulting the oracle. However, it is possible to generate the four line types in the proper ratios by using any of a number of numerical combinations. If one arbitrarily redefines the numerical values for the line types, and, for example, assigns 10 as the value of the old yin line, 30 for the old yang, 50 for the young yang, and 70 for the young yin line, it becomes possible to dispose many combinations of indicia on dice to yield the appropriate numerical totals in the correct ratios. It must always be borne in mind that the relative frequency distribution of 1:3:5:7 must be maintained in order to embody the yarrow-stalk probabilities.

Certain subsets of the very large number of theoretically possible dice can be reduced to formulas. If the numerical values of the line types are not altered arbitrarily, that is, if they are left at the values six, seven, eight, and nine, and if the set of potential indicia is restricted to whole numbers greater than or equal to zero, the possible combinations for marking bi- and tri-dice versions can be formulated as follows.

For versions employing two dice, both dice must have a number of indicia divisible by four. The first, or "A," die shall be marked with indicia equivalent to two consecutive whole numbers, x and x+1, from the range $0 \leqq x \leqq 6$, and in the ratio x:x+1=1:3. The second, or "B," die shall be marked with indicia equivalent to three consecutive whole numbers, y, y+1, and y+2, from the range $0 \leqq y \leqq 6$, and in the ratio y:y+1:y+2=1:2:1. x+y must equal six. The indicia of the bi-dice version discussed above clearly conform to this pattern. On the 2,3,3,3 die, x=2. The second, 4,5,5,6 die has y=4. Clearly other workable combinations are possible. One such combination would be 1,2,2,2 on the first die, and 5,6,6,7 on the second.

For versions using three dice, at least one, "A," die must have a number of indicia divisible by four. The second and third, or "B" and "C" dice must have a number of indicia divisible by two. The "B" and "C" dice need not be identical, and need not be of a similar form to the "A" die. The "A" die, as with the bi-dice version above, shall be marked with indicia equivalent to two consecutive whole numbers, x and x+1, from the range $0 \leqq x \leqq 6$, and in the ratio x:x+1=1:3. The "B" die shall be marked with indicia equivalent to two consecutive whole number values, y and y+1, from the range $0 \leqq y \leqq 6$, and in the ratio y:y+1=1:1. The "C" die shall likewise be marked with indicia equivalent to two consecutive whole number values, z and z+1, from the range $0 \leqq z \leqq 6$, and in the ratio z:z+1=1:1. x+y+z must equal 6. The numerical indicia of the preferred embodiment clearly conform to this pattern. The "A" die is marked 2,3,3,3, with x=2. The "B" and "C" dice are identical, both being marked 2,2,3,3, and with both y=2 and z=2. Clearly other workable combinations are possible. One such combination would have 1,2,2,2 on the "A" die, 2,2,3,3 on the "B" die, and 3,3,4,4 on the "C" die.

4) Variations on the Number of Dice-like Objects

A surprisingly large number of variations on the number of dice are possible. Anywhere from one to ninety-six dice, if they are appropriately marked, can be used to produce lines and hexagrams according to the proper, yarrow-stalk probabilities. In the discussions below, the terms "die" or "dice" should be interpreted broadly, and taken to include the ramifications discussed above in the section "Variations on the shape or form of the dice-like apparatus."

Further, where appropriate in the discussions that follow, after a variation is introduced, a sub-variation, or "super-set," is then discussed. That is, any dice-like apparatus capable of correctly generating a single I Ching line can be used in multiples in order to generate two or more lines at the same time. Embodiments of the invention which generate a single line can be duplicated up to six times to generate an entire hexagram at once. To accomplish this requires additional indicia. Take, for example, the preferred, tri-dice embodiment of the invention. In it, three dice are used to generate a single line. The dice are rolled a total of six times to create a complete hexagram. It would be possible, instead, to use a single "super-set" of eighteen dice to accomplish the same end. In addition to its numerical indicia, each die would also bear a second indicium, a color, say, linking each tri-dice apparatus together, and associating all three to one of the hexagram's six line positions. In all there would be six equivalent sub-sets, each identified with one of the line positions one through six. All eighteen dice would be rolled together; the numerical indicia on the three red dice, say, indicating line position one would be added, and the line type recorded. The numerical indicia on the three green dice, say, linked with the second line position would be added and the line type recorded; and so forth, in order to construct an entire hexagram with one roll of the super-set.

One die:

a) A single die with sixteen sides can be marked in the ratio 1:3:5:7. The die is rolled once for each line of the hexagram, and the line type for each roll is recorded. In this ramification, the indicia used may be the line symbols themselves, in preference to numerical indicia representing them. The form of the die can be two eight-sided pyramids joined at their bases, an elongated prism shape with sixteen substantially equal-sized faces, or any other geometric form providing an equal chance of producing four different results randomly in the ratio 1:3:5:7.

b) The first "super-set" comprises six sixteen-sided dice, each of which bears first indicia for the four line types, in the ratio 1:3:5:7, and a second indicium, for example a color, which links each individual die with one of the line positions one through six. In this way, a user can toss all six dice at once, and obtain all six lines of a hexagram at one throw.

Two dice:

a) The bi-dice form of the invention is discussed above as the "Alternative embodiment" and under the heading "Different indicia."

b) A "super-set" comprises twelve dice, based on one of the bi-dice versions, with second indicia, for example colors, allowing the querist to generate all six lines of a hexagram at once.

Three dice:

a) The tri-dice form of the invention is discussed at length above as the preferred embodiment. Further possible tri-dice variations are discussed under the heading "Different indicia."

b) A "super-set" of eighteen dice allows the querist to generate all six lines of a hexagram at once. Each die bears a second indicia, for example a color, so that each subset of three dice can be distinguished. A key is provided whereby each color-coded subset is identified with one of the six line positions in a hexagram. All eighteen dice are rolled at once, the totals of the numerals on the vertices of each colored sub-set are added, and a key is used so that each line is recorded appropriately.

Sixteen dice:

a) Sixteen dice are marked using line symbols for indicia. Each die bears one symbol for one line type only, and the four line type symbols are disposed on the sixteen dice in the ratio 1:3:5:7. Since the dice are marked with line type symbols, reference to the line type key (34) shown in FIG. 5 is unnecessary. In this ramification it is also unnecessary for the dice to have a number of faces divisible by four.

This dice-like ramification is similar to, but differs from the draw-like marble method discussed as prior art above. In that apparatus, one marble at a time was drawn at random from a common pool. Here the sixteen dice are thoroughly shaken or mixed, and rolled all at once onto or across a flat surface such as a table. If a single die comes to rest with its indicium facing up, that is the result of the throw, and is recorded as the first line of the initial hexagram. If no die comes to rest with an indicium facing up, all the dice are gathered, mixed, and rolled again. If two or more dice come to rest with indicia facing up, those dice are gathered together, shaken, and rolled again. This procedure is repeated until exactly one die comes to rest with an indicium facing up. That indicium is then judged the result of the throw, and recorded in the first line position of the hexagram being constructed. After the first line is recorded, the sixteen dice are mixed and rolled for each remaining line, until the hexagram is completed.

b) A "super-set" of ninety-six dice comprises six sub-sets of sixteen dice each. All the dice are substantially identical in size, shape, weight, etc., but differ in their markings. Each die bears at least two indicia. The first indicium represents one of the four line types. The second indicium, for example a color, is common to each sub-set of sixteen dice, and associates said group with one of the six hexagram line positions. The line type indicia are distributed among the sixteen dice of each group, and throughout the entire ninety-six dice, in the ratio 1:3:5:7. That is, out of the ninety-six dice, six represent the mature yin line, eighteen the mature yang line, thirty the young yang line, and forty-two the young yin line. It is not necessary for the dice to have a number of faces divisible by four.

To consult the oracle using such a "super-set," the querist uses a procedure similar to the operation discussed directly above under "Sixteen dice." Each group of sixteen dice of the same color eventually yields a single line type symbol for a specific line position. For example, sixteen red dice would yield a result for the first line position, say, and sixteen green dice a result for the second line position, etc. To begin, all ninety-six dice are mixed together, and rolled onto or across a flat surface such as a table. The querist examines all the red dice, say, which are linked to the first hexagram line position, to see if any have come to rest with indicia facing up. If exactly one indicium has come to rest facing up, that is the result of the throw, and that line type symbol is recorded in the first line position. If none of the red dice, or if two or more of the red dice have come to rest with indicia facing up, the querist proceeds as discussed under "Sixteen dice" above until exactly one red die comes to rest with its line type indicium facing up. That line type symbol is then recorded in the first line position of the hexagram being constructed.

The querist then examines all dice linked to the second hexagram line position, all the green dice, say, and proceeds as above until exactly one green die yields a single line type indicium. That line type symbol is then recorded in the second hexagram line position. The process is repeated with all six groups of sixteen dice until the initial hexagram is completed.

Other-numbers of dice:

a) As discussed under the heading "Different indicia" above, one might arbitrarily re-define the numerical target values as other than 6, 7, 8, and 9. By so doing, or by using indicia such as zeroes and fractions, it is possible to construct dice-like apparatuses comprising virtually any number of individual dice and to generate lines according to the proper yarrow-stalk probabilities.

b) "Super-sets" of any such sub-sets are theoretically possible.

5) Different Methods of Operation

In the discussion of both the preferred embodiment and the main alternative embodiment above, the operation of the invention is basically the same. The dice are rolled on a surface such as a table, the numerical indicia are summed, reference is made to a key to indicate the appropriate line type generated, and the line type is recorded in the appropriate line position.

Many different techniques, and variations on this basic technique are possible. Instead of rolling all the dice at once, say, they could be rolled one at a time. Alternatively, the dice could be drawn out of a container and placed on a table one at a time. The dice can be manipulated in the hands, and simply revealed one at a time. The dice can be used in conjunction with special table surfaces which have recesses, holes, pockets, or lines demarcating targets or zones. Various combinations of rolling, shaking, mixing, tumbling, manipulating and then revealing the indicia are possible. In using the "super-sets" discussed directly above, up to ninety-six dice can be manipulated in many various ways, and the line positions evaluated in different orders.

Alternative methods of recording line results are possible. In addition to paper and pen, which are most commonly used, one might use a computer, or a device such as Dhiegh's invention, U.S. Pat. No. 3,598,414, made specifically for the purpose.

When changing lines are present, at least three variations in the sequence of constructing hexagrams and consulting the I Ching text are possible. 1) As drawn in the flowsheet FIG. 7, the initial hexagram is constructed (Box 3) and its interpretation is read (Box 6) before considering the changing lines. 2) In an alternative method, as soon as a changing line is generated in whichever line position, the recording of a resultant hexagram is begun. That is, as soon as any mature line is generated for the initial hexagram (Box 3), the appropriate line type symbol is recorded for that hexagram and the opposite line type is recorded for the resultant hexagram (Box 9). Thereafter, for the remaining dice throws, each outcome is recorded with the appropriate line in both Box 3 and Box 9; the two hexagrams are constructed simultaneously. When both are complete, the user refers to the text for the initial hexagram, Box 6, and then to the text for the resultant hexagram, Box 10. 3) In a further variation, the resultant hexagram can be constructed after the initial hexagram is completed, but before the text for the initial hexagram is consulted. This path on the flowsheet would proceed from Box 4 to Boxes 8 and 9, then to Box 6, and finally to Box 10.

The preferred embodiment is intended to generate only one line at a time. This is thought to reinforce a more protracted, thoughtful, contemplative approach to the oracle. But as noted with the ramifications called "super-sets" discussed above, it is also possible, within the scope of the present invention, to generate from two to six lines of a hexagram at once by using multiples of the basic invention.

6) "Hybrid" Apparatus

The unique, asymmetrical numbering of the 2,3,3,3 die (30) gives it a special quality. It can be used in conjunction with whatever other objects can be made to yield "2"s and "3"s in equal proportion, and in random order. These do not need to be dice. For example the 2,3,3,3 die can be used together with two regular coins. If each coin is determined to have one side that equals "2," and another side equaling "3," and if the die and two coins are tossed together, this apparatus will yield results equivalent to those of the preferred embodiment of the invention. That is to say that the results will re-create the yarrow-stalk frequency distribution of 6,9,8, and 7 in the ratio 1:3:5:7.

The special characteristic of this die is the ratio of its indicia, and not the specific indicia "2" and "3." Many other workable combinations are possible, for example 1,2,2,2 or 3,4,4,4. The pattern is that the die be marked with indicia representing two consecutive whole number values, where the lower value is both greater than or equal to zero and less than or equal to six, and where there are three times as many indicia of the higher value than of the lower.

This same property allows the 2,3,3,3 die to be used in conjunction with standard six-sided dice. That is to say that one 2,3,3,3 die can be tossed with two special six-sided dice if each six-sided die is marked with equal numbers of "2"s and "3"s. The results will recreate the proper relative frequency distribution of 6,9,8, and 7 in the ratio 1:3:5:7. Alternatively, two conventional six-sided dice can be used, if it is agreed, for example, that the three even numbers shall be counted as "two," and the three odd numbers as "three."

Similarly, the 2,3,3,3 die can be used in conjunction with any two chance-generating devices that produce 2s and 3s in equal proportions. In addition to coins and six-sided dice, as indicated above, these include octahedral, dodecahedral, icosahedral or any of a number of other dice-like shapes or polyhedra with a number of faces divisible by two, including domino-like plaques or tablets.

The quality of the 2,3,3,3 die that allows it to generate the yarrow-stalk probabilities when used in conjunction with objects such as coins makes it extremely versatile and portable. This die can be used with any device capable of displaying any two discrete outcomes, randomly, one at a time. Thus the 2,3,3,3 die can be used with a single coin, for example, tossed twice. With heads equal "2" and tails equal "3," for example, this apparatus can replicate the yarrow-stalk probabilities. Likewise, instead of special six-sided dice marked with "2"s and "3"s, a single, conventional six-sided die can be used, provided that one establishes an equivalence at the outset that the even numbers of the die equal the outcome "two," say, and the odd numbers equal "three." In this method the user would roll the 2,3,3,3 die once, and a regular six-sided die twice to obtain each line of a hexagram. The 2,3,3,3 die can also be used in conjunction with a standard deck of cards, with, say, red=2, and black=3. For each line the querist rolls the die, and takes two cards at random from a deck. The deck of cards should not contain jokers.

These examples are not intended to be exhaustive or comprehensive. The reader will appreciate that there are a great number of ways to generate such an essentially binary outcome.

I claim:

1. A dice-like apparatus for calculating the lines of I Ching hexagrams, comprising:

a) three polyhedral shapes of a form having a number of equal-area faces divisible by four;

b) each of said polyhedral shapes bearing in common reading positions a first indicium equivalent to the numerical value "two" and a second indicium equivalent to the numerical value "three";

$b^1$) one of said polyhedral shapes bearing said indicia in the ratio "two":"three"=1:3;

$b^2$) two of said polyhedral shapes bearing said indicia in the ratio "two":"three"=2:2.

2. A dice-like apparatus for casting a plurality of I Ching lines at one time, comprising the apparatus of claim 1, and further comprising:

a) a plurality of said dice-like apparatuses, and b) each said apparatus bearing a common second indicia, for example a color, linking said apparatus to a specific hexagram line position.

3. The apparatus of claim 1 wherein said apparatus is made of wood.

4. The apparatus of claim 1 wherein said apparatus is made of plastic.

5. The apparatus of claim 1 wherein said apparatus is made of metal.

6. The apparatus of claim 1 wherein said polyhedral shapes are rounded tetrahedral forms.

7. A die-like apparatus for calculating the lines of I Ching hexagrams, comprising:

a) a polyhedral shape of a form having a number of equal-area faces divisible by four, and b) a first and a second indicia equivalent to two consecutive whole number values, "x" and "x+1," where $0 \leqq x \leqq 6$, and c) said indicia disposed on said polyhedral shape in common reading positions in the ratio x:x+1=1:3.

8. A dice-like apparatus for calculating the lines of I Ching hexagrams comprising the apparatus of claim 7, and further comprising:

a) a second polyhedral shape of substantially identical size, weight, and form to said polyhedral shape of claim 7, and b) said second polyhedral shape bearing first, second, and third indicia equivalent to three consecutive whole number values, y, y+1, and y+2, from the range $0 \leqq y \leqq 6$, and in the ratio y:y+1:y+2=1:2:1, and c) the sum of said whole number values x and y equal to 6.

9. A dice-like apparatus for casting a plurality of I Ching lines at one time, comprising the apparatus of claim 8, and further comprising:

a) a plurality of said dice-like apparatuses, and b) each said apparatus bearing a common second indicia, for example a color, linking said apparatus to a specific hexagram line position.

10. The apparatus of claim 8 wherein:

a) both said polyhedral shapes are rounded, substantially tetrahedral forms, and wherein b) said first tetrahedral form is marked with a first indicium equivalent to a numerical value "two" and three second indicia equivalent to a numerical value "three," and wherein c) said second tetrahedral form is marked with a first indicium equivalent to a numerical value "four," two second indicia equivalent to a numerical value "five," and a third indicium equivalent to a numerical value "six," and wherein e) all said indicia are disposed in common reading positions.

11. The apparatus of claim 8 wherein:

a) both said polyhedral shapes are rounded, substantially tetrahedral forms, and wherein b) said first tetrahedral form is marked with a first indicium equivalent to a numerical value "three" and three second indicia equivalent to a numerical value "four," and wherein c) said second tetrahedral form is marked with a first indicium equivalent to a numerical value "three," two second indicia equivalent to a numerical value "four," and a third indicium equivalent to a numerical value "five," and wherein e) all said indicia are disposed in common reading positions.

12. The apparatus of claim 8 wherein said apparatus is made of wood.

13. The apparatus of claim 8 wherein said apparatus is made of plastic.

14. The apparatus of claim 8 wherein said apparatus is made of metal.

15. The apparatus of claim 8 wherein said polyhedral shapes are rounded tetrahedral forms.

16. A method for selecting lines of I Ching hexagrams, comprising:

(a) providing a dice-like means capable of producing randomly four distinct outcomes in a relative frequency distribution 1:3:5:7, (b) specifying that the outcome with probability one in sixteen is equivalent to an old yin line; that the outcome with probability three in sixteen is equivalent to an old yang line; that the outcome with probability five in sixteen is equivalent to a young yang line; and that the outcome with probability seven in sixteen is equivalent to a young yin line, (c) manipulating said dice-like means in order to produce one of said outcomes, noting said outcome, and recording said line type, (d) repeating step (c) a pre-determined number of times in order to construct a six-line I Ching hexagram, whereby said hexagram will be constructed in accordance with the statistical principles of the I Ching, and whereby an I Ching user can discover heretofore obscured order in the I Ching.

17. The method of claim 16 wherein a plurality of dice-like means allow the generating of a plurality of I Ching lines at one time.

18. A dice-like apparatus for calculating the lines of I Ching hexagrams comprising the apparatus of claim 7, and further comprising:

a) second and third polyhedral shapes of substantially identical size, weight, and form to said polyhedral shape of claim 7, and b) said second polyhedral shape bearing a first and second indicia equivalent to two consecutive whole number values, y and y+1, from the range $0 \leqq y \leqq 6$, and in the ratio y:y+1=2:2, and c) said third polyhedral shape bearing a first and second indicia equivalent to two consecutive whole number values, z and z+1, from the range $0 \leqq z \leqq 6$, and in the ratio z:z+1=2:2, and d) the sum of said whole number values x+y+z equal to 6.

19. An apparatus for casting lines of I Ching hexagrams comprising the apparatus of claim 7, and further comprising:

a) said polyhedral shape of claim 7 bearing indicia equivalent to the numerical values "two" and "three" in the ratio "two":"three"=1:3, and b) two coins, each bearing an indicium on one side equivalent to the numerical value "two," and each bearing an indicium on the other side equivalent to the numerical value "three."

* * * * *